US005148697A

United States Patent [19]

Shiraishi et al.

[11] Patent Number: 5,148,697

[45] Date of Patent: Sep. 22, 1992

[54] METHOD FOR WITHDRAWING WORKPIECE FROM DRAWING MOLD

[75] Inventors: Motoatsu Shiraishi; Tatsuo Nagamitsu; Mitsuki Nakamura, all of Saitama, Japan

[73] Assignee: Honda Giken Kogyo Kabushiki Kaisha, Tokyo, Japan

[21] Appl. No.: 687,348

[22] Filed: Apr. 18, 1991

[30] Foreign Application Priority Data

Apr. 19, 1990 [JP] Japan ..... 2-104140
Oct. 18, 1990 [JP] Japan ..... 2-280233

[51] Int. Cl.[5] ..... B21D 43/05

[52] U.S. Cl. ..... 72/405; 72/361; 414/225; 414/752

[58] Field of Search ..... 72/405, 421, 422, 361, 72/356; 198/621; 414/225, 625, 752, 750

[56] References Cited

FOREIGN PATENT DOCUMENTS 38240058 11/1989 Fed. Rep. of Germany .
289928 12/1986 Japan ..... 72/405
299729 12/1990 Japan ..... 72/405
1250117 10/1971 United Kingdom ..... 72/405
2199525 7/1988 United Kingdom .
2223973 4/1990 United Kingdom .

*Primary Examiner*—Daniel C. Crane
*Attorney, Agent, or Firm*—Armstrong & Kubovcik

[57] ABSTRACT

A path for retreating movement of a cross bar from a standby position between a drawing mold and a mold of the next step to the drawing mold for holding the workpiece drawn by the drawing mold and a path for advancing movement of the cross bar holding the workpiece to the mold of the next step are formed into an upwardly smoothly curved line, and raising of a blank holder for the drawing mold is stopped temporarily for a period until the workpiece is discharged from the drawing mold by the cross bar. The paths for movement of the cross bar includes no suddenly turning portion and hence, any vibration of the cross bar due to an inertia force is prevented. Even if the paths for movement of the cross bar associated with all the molds are established in the same form, it is avoided that the cross bar or the workpiece interferes with the blank holder in the drawing mold.

3 Claims, 14 Drawing Sheets

METHOD FOR WITHDRAWING WORKPIECE FROM DRAWING MOLD

BACKGROUND OF THE INVENTION

1. Field of the Invention

The field of the present invention is methods for withdrawing a workpiece from a drawing mold by a cross bar having holding means such as a suction cup to transport the workpiece drawn by the drawing mold toward a mold of a next step.

2. Description of the Prior Art

There is a conventionally known so-called transfer press comprising a plurality of molds such as a drawing mold, a trimming and piercing mold and a bending mold which are arranged in line in the order of processing, and a pair of left and right feed bars mounted on opposite sides of the molds for cyclic motion in a vertical plane and connected together by a plurality of cross bars, wherein a workpiece adsorbed or attracted by a holding means such as a suction cup mounted on the cross bar is transported sequentially toward the mold of the next step by the cyclic motion.

The cyclic motion of the feed bar in such transfer press is generally formed of a combination of an upward movement, a horizontal movement, a downward movement and the like. For this reason, a large inertia force acts on the feed bar and/or the cross bar when the motion changes from a vertical movement to a horizontal movement and vice versa, providing a cause for vibration in the cross bar which has a relatively low strength. If the cross bar is formed to have a larger thickness to increase its rigidity in order to prevent this disadvantage, the inertia force may be increased by an increase in weight to bring about inconveniences such as making vibration further violent and necessitating a larger-sized drive mechanism.

In order to avoid the above disadvantages, it can be conceived that a path for the cyclic motion of the feed bar which has hithereto been a combination of the vertical movement and the horizontal movement is formed of a smooth curved line, thereby reducing the generation of the inertia force.

However, among the plurality of molds used in the transfer press, the drawing mold includes a blank holder liftably disposed around the outer periphery of a lower die, unlike the other molds, and the blank holder is adapted to be raised to an upper position above the lower die along with the workpiece after completion of the drawing. For this reason, if the cross bar on standby in an intermediate position between the drawing mold and the mold of the next step is intended to be moved to a position between the lower and upper dies of the drawing mold through a movement path formed of the above-described curved line, there is a possibility of the cross bar interfering with the raised blank holder. If the cross bar holding a workpiece is likewise intended to be moved from the drawing mold toward the mold of the next step along the movement path in the form of the curved line, there is a possibility that the cross bar or the workpiece held by the cross bar interferes with the blank holder. For such a reason, there is a need for independently establishing a path for movement of the cross bar along which the bar withdraws a workpiece from the drawing mold and a path for movement of the cross bar along which it withdraws a workpiece from the other mold. This may be a cause for complication of the structure of a transporting mechanism and lowering in the transporting speed.

SUMMARY OF THE INVENTION

Accordingly, it is an object of the present invention to provide a method for withdrawing a workpiece from a drawing mold, in which the inertia force generated with the cyclic motion of a cross bar can be reduced, and the cyclic motions of the cross bars corresponding to all the molds including the drawing mold can be performed through a common motion curve.

To achieve the above object, according to a first aspect of the present invention, there is provided a method for withdrawing a workpiece from a drawing mold, comprising lowering a workpiece placed on a blank holder, which is in an upper limit position, toward a lower die, drawing the workpiece by cooperation of the lower die with an upper die, raising the upper die after completion of the drawing, and retreating a cross bar means capable of holding the workpiece from a standby position established between the drawing mold and a mold of a next step to between the lower die and the upper die to hold the workpiece and then advancing the cross bar means toward the mold for the next step, wherein a path for the retreating movement of the cross bar means from the standby position to between the lower die and upper die and a path for the advancing movement of the cross bar means from between the both dies to the mold for the next step are formed into an upwardly smoothly curved line, and the raising of the blank holder is stopped temporarily for a period until the workpiece is descharged from the lower die in order to avoid any interference of the cross bar means and the workpiece held by the cross bar means with the blank holder.

With the above construction, in withdrawing the drawn workpiece from the drawing mold by the cross bar means, the blank holder for the drawing mold is stopped temporarily at a lowered position. Therefore, even if the path for the retreating movement of the cross bar means from the standby position to the drawing mold and the path for the advancing movement of the cross bar means from the drawing mold to the mold of the next step are formed into the upwardly smoothly curved line, it is avoided that the cross bar means or the workpiece held by the cross bar means interferes with the blank holder. This enables all the cross bar means mounted in correspondence to the molds to perform a common cyclic motion along the above-described curved line. As a result, any suddenly turning portion is eliminated from the path for the cyclic motion, ensuring not only that a large inertia force can be prevented from acting on the cross bar means, but also a driving mechanism for the cross bar means can be simplified.

Further, according to a second aspect of the present invention, the cross bar means comprises a first cross bar and a second cross bar which are juxtaposed in a transporting direction of the workpiece for movement toward and away from each other and are capable of cooperating to hold the workpiece, the method further comprising the steps of holding the workpiece on the cross bar means with the first and second cross bars being kept at a distance from each other during advancing movement of the cross bars, and moving the first and second cross bars toward each other when these cross bars reach the standby position during retreating movement thereof. With the above construction, it is possible to conduct a stable high-speed transportation while holding the outer periphery of the workpiece and preventing any deflection thereof, because the first and second cross bars cooperating to hold the workpiece are kept at a distance from each other when transporting the workpiece from the mold of a preceding step to the mold of a succeeding step. In the retreating movement of the first and second cross bars which have completed the transportation of the workpieces, they are moved toward each other at the intermediate standby position. Therefore, it is possible to reduce the space occupied by the first and second cross bars at such standby position.

The above and other objects, features and advantages of the invention will become apparent from a reading of the following description of the preferred embodiments, taken in conjunction with accompanied drawings.

BRIEF DESCRIPTION OF THE DRAWINGS

FIGS. 1 to 4 illustrate a first embodiment of the present invention, wherein FIG. 1 is a side view of the entire transfer press;

FIG. 2 is a plan view taken along a line II—II in FIG. 1;

FIG. 3 is a sectional view taken along a line III—III in FIG. 2; and

FIG. 4 is a view for explaining the operation; and

FIGS. 5 to 16 illustrate a second embodiment of the present invention, wherein FIG. 5 is a side view of the entire transfer press;

FIG. 6 is a plan view taken along an arrow VI in FIG. 5;

FIG. 7 is an enlarged view of an essential portion shown in FIG. 5;

FIG. 8 is a detailed view of an operatively connecting device;

FIG. 9 is a sectional view taken along a line IX—IX in FIG. 8;

FIG. 10 is a view taken along an arrow X in FIG. 8;

FIG. 11 is an enlarged view of a portion encircled by a dashed line XI in FIG. 6;

FIG. 12 is a sectional view taken along a line XII—XII in FIG. 11;

FIG. 13 is a view of a driving system for the operatively connecting device; and FIGS. 14 to 16 are views for explaining the operation.

DESCRIPTION OF THE PREFERRED EMBODIMENTS

A first embodiment of the present invention will now be described with reference to FIGS. 1 to 4.

Figure 1:
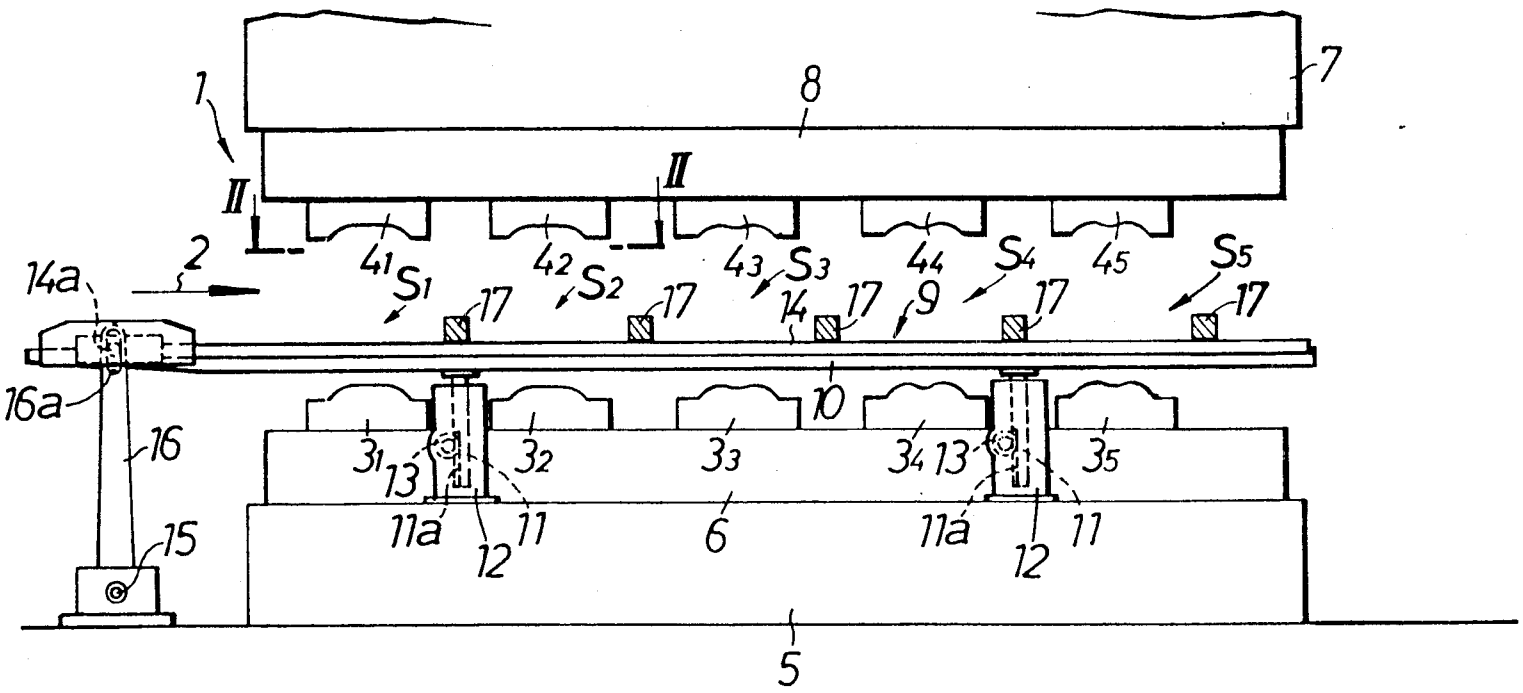

Referring to FIG. 1, a plurality of working stations, e.g., first to fifth working stations $S_1$ to $S_5$ are provided in a press 1 in a workpiece transporting direction 2. Lower dies $3_1$ to $3_5$ and upper dies $4_1$ to $4_5$ for pressing a workpiece W in cooperation are disposed in the working stations $S_1$ to $S_5$, respectively. More specifically, the lower dies $3_1$ to $3_5$ are fixed to a bolster 6 of a base 5 at predetermined distances therebetween in the transporting direction 2, and the upper dies $4_1$ to $4_5$ are supported in an opposed relation to the corresponding lower dies $3_1$ to $3_5$ on a bolster 8 fixed to a lift stand 7. A transporting device 9 is added to the press 1 and adapted to be operated after pressing of the workpieces W by the lower dies $3_1$ to $3_5$ and the upper dies $4_1$ to $4_5$, thereby sequentially transporting the workpieces W toward the adjacent working stations $S_1$ to $S_5$.

The transporting device 9 includes a pair of left and right guide bars 10, 10 disposed on opposite sides of the working stations $S_1$ to $S_5$ in parallel to the transporting direction 2. A support rod 11 mounted on a lower surface of each of the guide bars 10, 10 is vertically movably supported by a support post 12. Each of the left and right guide bars 10, 10 is driven for upward and downward movement by reciprocally rotatively driving a pinion 13 meshed with a rack 11*a* formed on a side of each of the support rods 11. Feed plated 14, 14 are slidably carried on the left and right guide bars 10, 10 over the entire length thereof for sliding movement in a longitudinal direction, i.e., in the transporting direction 2. An elongated hole 16*a* is provided in an upper end of a swingable arm 16 secured at its lower end to a drive shaft 15 which is reciprocally rotatively driven, and a pin 14*a* mounted at one end of each of the feed plates 14 is engaged in the elongated hole 16*a*.

Thus, the feed plates 14, 14 perform their cyclic motion through a closed path which will be described hereinafter, by the upward and downward movements of the guide bars 10, 10 provided by the reciprocal turning movements of the pinions 13 and the longitudinal movements of the feed plates 14, 14 provided by the reciprocal rotation of the drive shaft 15.

Figure 2:
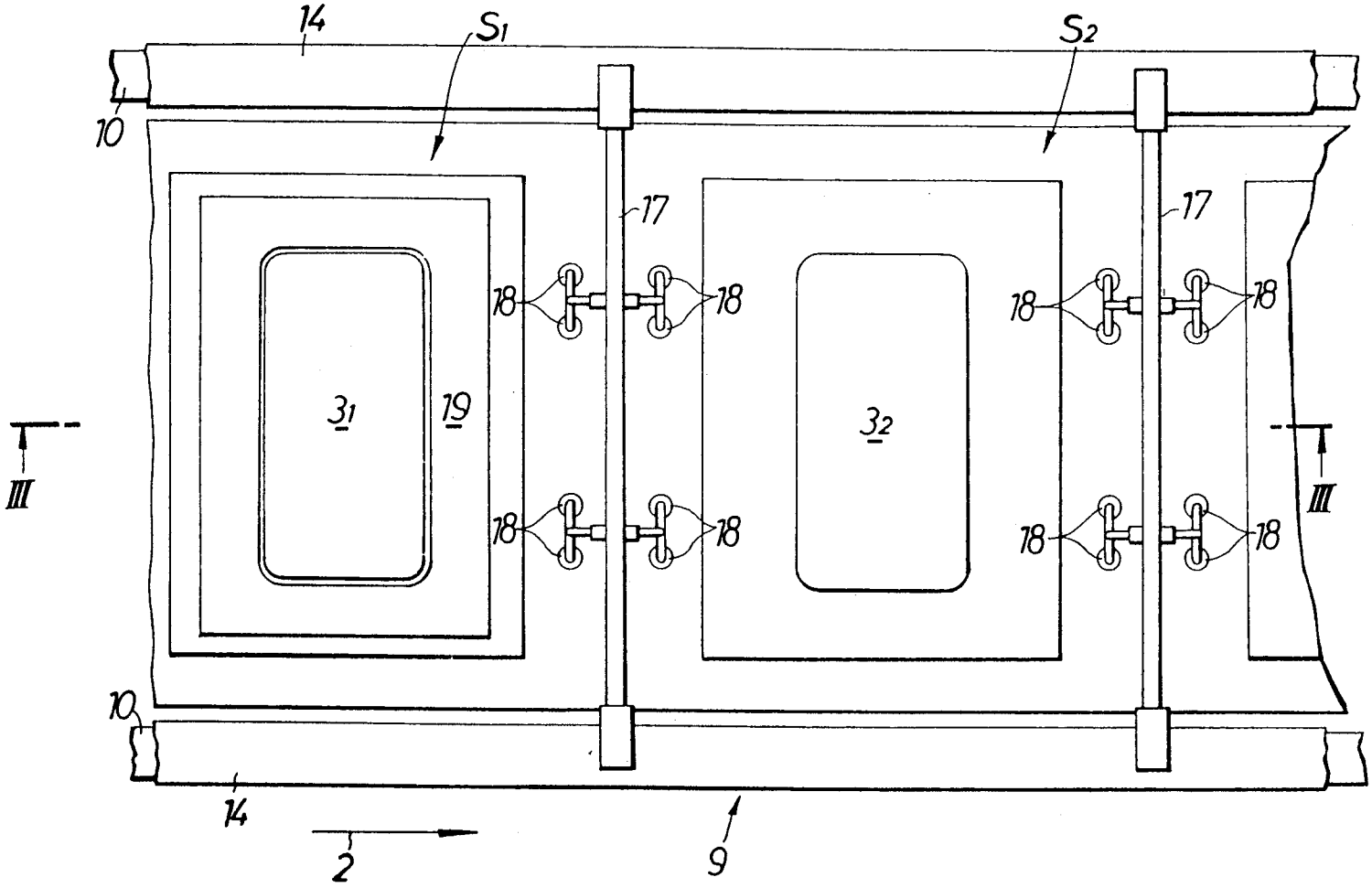

As apparent by reference to FIGS. 1 and 2, the left and right feed plates 14, 14 are interconnected by six cross bars 17 transversely disposed therebetween. Each cross bar is provided with four suction cups 18 for attracting and retaining an upper surface of the workpiece W.

Figure 3:
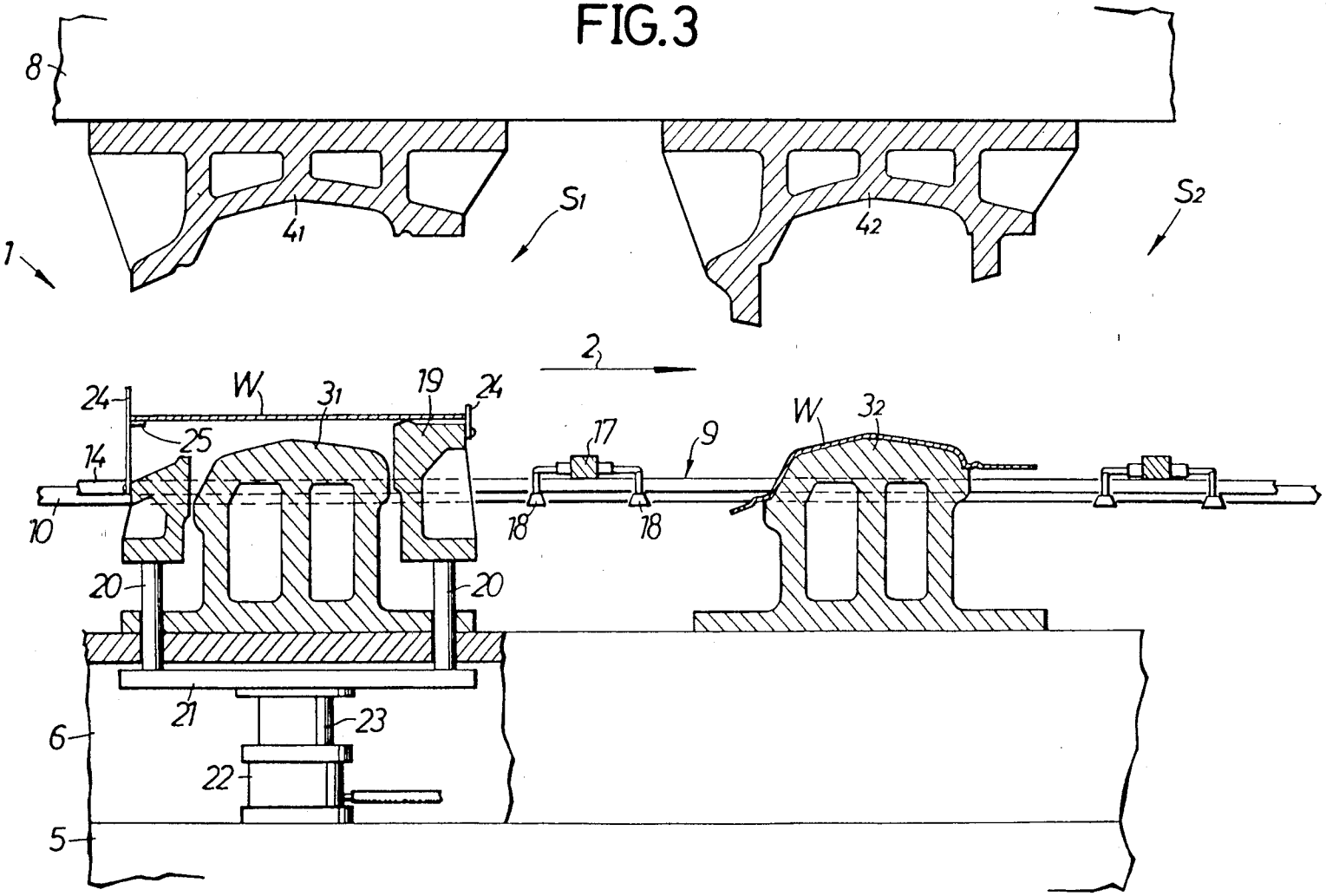
Figure 4:
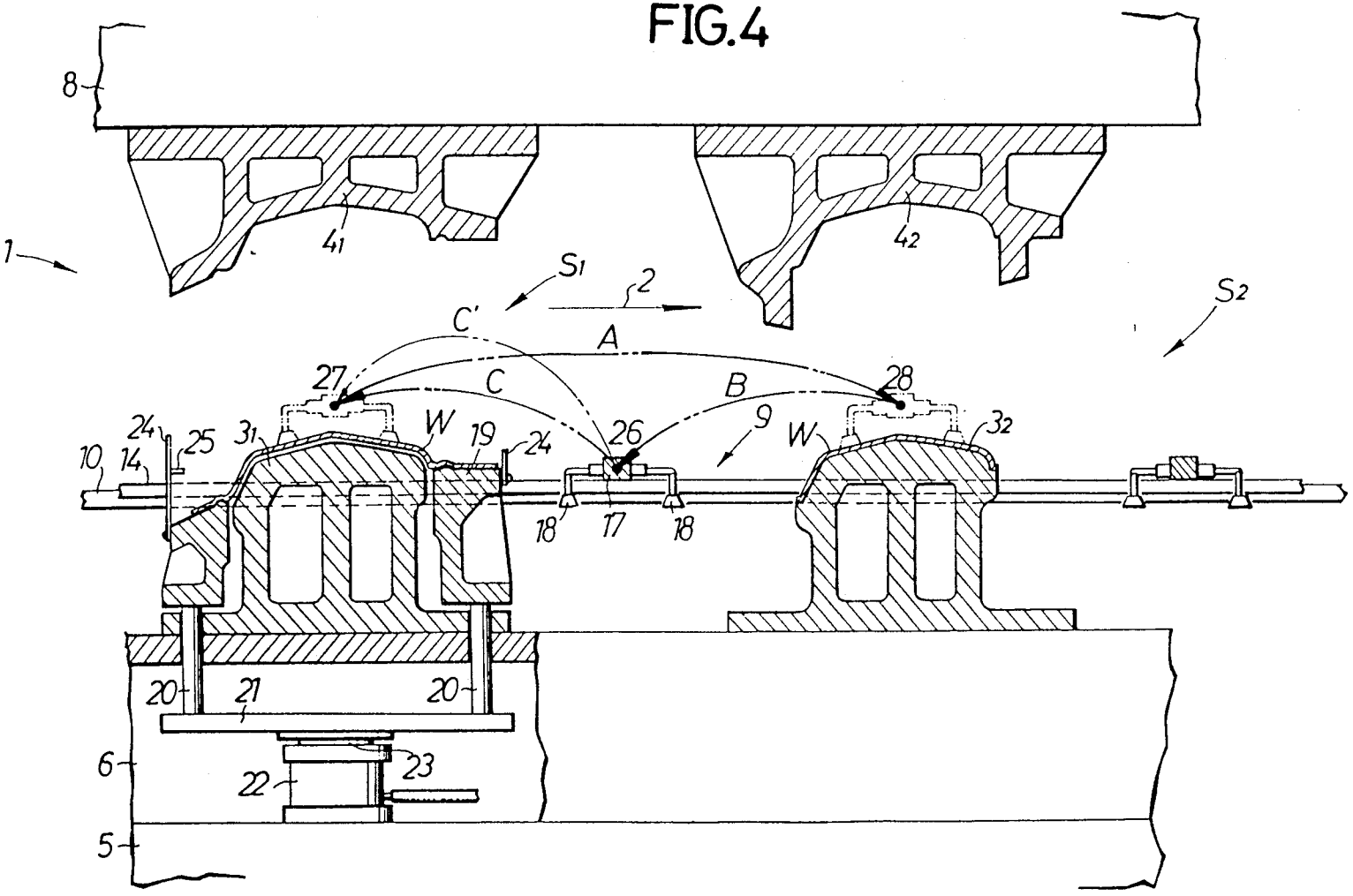

Referring to FIG. 3, a liftable blank holder 19 is disposed around the outer periphery of the lower die $3_1$ in the working station $S_1$ for drawing a workpiece W. The blank holder 19 is vertically movably supported by a plurality of cushion pins 20 extending vertically through the lower die $3_1$ and an upper surface of the bolster 6. The cushion pins 20 are connected at their lower ends to a common support plate 21 within the bolster 6. A lower surface of the support plate 21 at a central portion thereof is supported by a rod 23 of a cylinder 22 standing on the base 5, so that the expansion and contraction of the cylinder 22 cause the blank holder 19 to be raised and lowered. A support member 24 is mounted around the outer periphery of the blank holder 19 at its upper portion, and a blank as a workpiece W can be supported by a plurality of claws 25 projecting from an inner surface of the support member 24.

It should be noted that the working station provided with the blank holder 19 is only the working station $S_1$ for drawing the workpiece W, and the subsequent working stations, i.e., the working station $S_2$ for conducting a trimming and piercing at the next step and the downstream stations $S_3$ to $S_5$ are not provided with the blank holder 19.

The operation of the first embodiment will be described below. While the pressings are conducted simultaneously in the working stations $S_1$ to $S_5$ by the lower dies $3_1$ to $3_5$ and the upper dies $4_1$ to $4_5$, the six cross bars 17 connecting the left and right guide bars 10, 10 are on standby in standby positions 26 intermediate the adjacent twos of the working stations $S_1$ to $S_5$ (see FIG. 4). At this time, in the working station $S_1$ for conducting a drawing, the workpiece W in the form of a blank, as shown in FIG. 3, has been previously placed on the claws 25 of the support plate 24 mounted around the blank holder 19 which is in its upper limit position. The upper die $4_1$ is lowered from this state to clamp the workpiece W between the upper die $4_1$ and the blank holder 19. As the upper die $4_1$ is further lowered, the blank holder 19 is also lowered along with the upper die $4_1$ while compressing the cylinder 22, so that the workpiece W is drawn by the cooperation of the upper die $4_1$ with the lower die $3_1$. Thereafter, the upper die $4_1$ is raised to its original position, but the expansion of the cylinder 22 is stopped temporarily, so that the blank holder 19 cannot be raised along with the upper die $4_1$ and is held in a lower position shown in FIG. 4. However, the blank holder 19 is slightly raised by the remaining pressure in the cylinder 22, thereby permitting the drawn workpiece W to be released from the lower die $3_1$.

When the pressings in the working station $S_1$ for conducting the drawing and all the other stations $S_2$ to $S_5$ are simultaneously completed, the pinions 13 in the transporting device 9 are rotatively driven to raise the guide bars 10, 10 and at the same time, the drive shafts 15 is rotatively driven to horizontally move the feed plates 14, 14 supported on the guide bars 10, 10, thereby moving the cross bar 17 having the suction cups 18 along an upwardly smoothly curved path C from the standby position 26 into a space 27 between the lower die $3_1$ and the upper die $4_1$, so that the suction cups 18 attract and retain the drawn workpiece W. If the blank holder 19 has been returned to the upper limit position at this time, the cross bar 17 interferes with the raised blank holder 19 if it does not pass through a path C'. However, because the blank holder 19 is held temporarily in the lowered position, the interference of the cross bar 17 with the blank holder 19 is avoided.

When the drawn workpiece W has been attracted and held by the suction cups 18 of the cross bar 17, the transporting device 9 is operated again to move the cross bar 17 along an upwardly smoothly curved path A into a space 28 between the lower die $3_2$ and the upper die $4_2$ in the working station $S_2$ for conducting a trimming at the next step. Even at this time, the blank holder 19 is in the lowered position, thereby avoiding the interference of the blank holder 19 with the workpiece W held by the cross bar 17. Then, the cross bar 17 is returned to the standby position 26 along an upwardly smoothly curved path B after releasing the workpiece W onto the lower die $3_2$ in the working station $S_2$. Of course, while the cross bar 17 which takes out the drawn workpiece W from the working station $S_1$ performs its cyclic motion through the paths A, B and C, all the other fifth cross bars 17 also perform their cyclic motions through paths of the same shape to transport the workpieces W to the next working stations, respectively. When the cross bar 17 and the workpiece W held by the cross bar 17 has been moved to a position where there is no fear of the interference of the workpiece W with the blank holder 19, the cylinder 22 is expanded to cause the blank holder 19 to be returned to the upper limit position.

Since the paths A, B and C through which the cross bar 17 cyclically moves are formed into a smoothly curved line, any large inertia force is prevented from acting on the cross bar 17 which is moving, thereby eliminating such disadvantages that the cross bar 17 is vibrated and the held workpiece W will fall. Moreover, the take-out of the workpiece W can be started after completion of the drawing without waiting for the return of the blank holder 19 to the upper limit position and hence, it is possible to reduce the working time.

A second embodiment of the present invention will now be described with reference to FIGS. 5 to 16.

Figure 5:
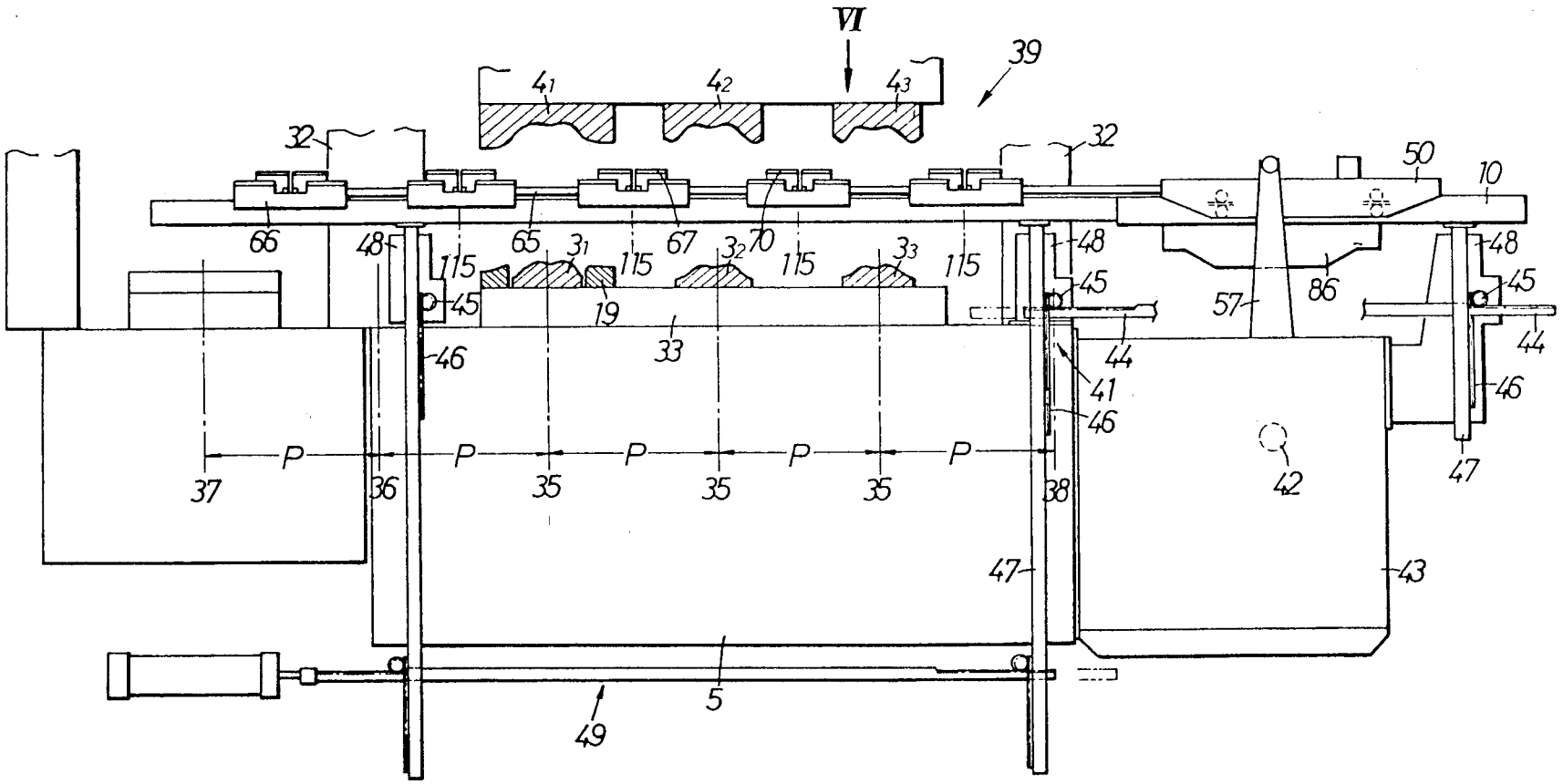
Figure 6:
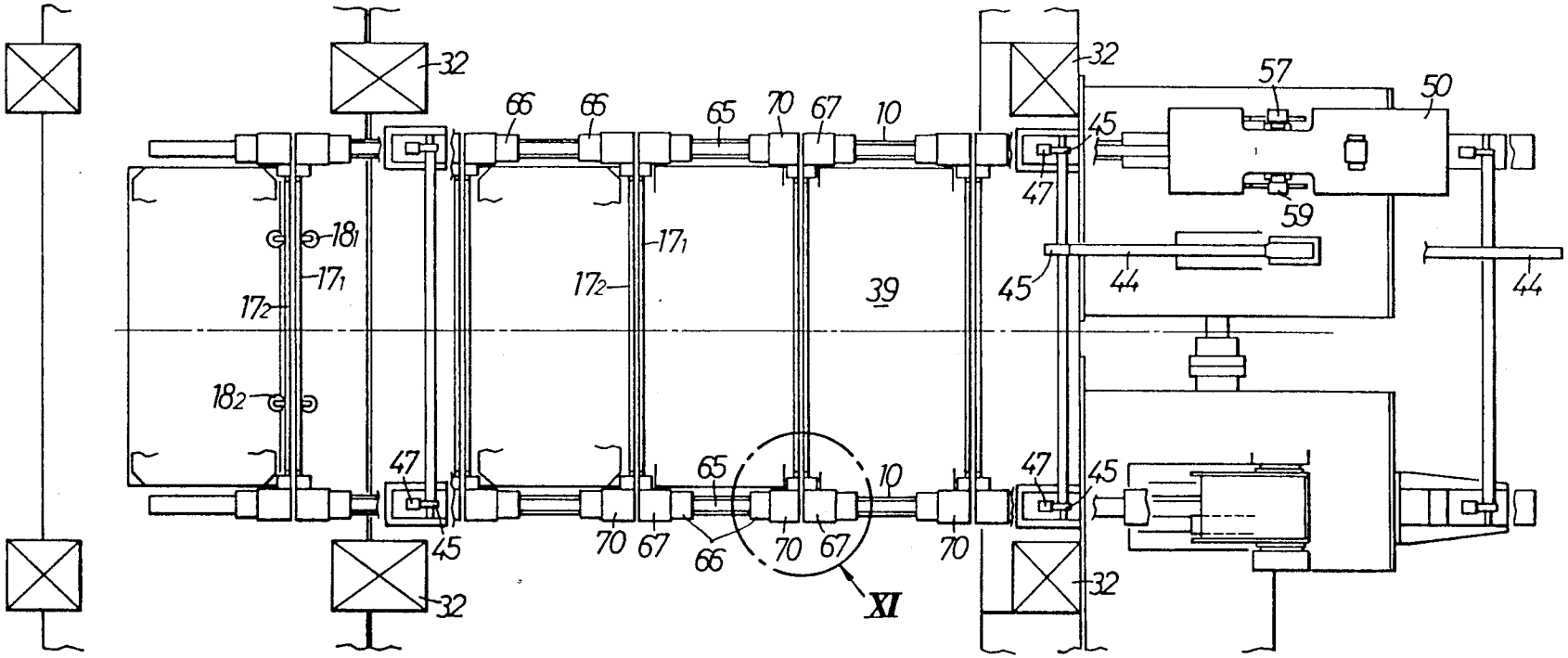

Referring to FIGS. 5 and 6, a base formed between uprights 32 is shown by a reference numeral 5. A carriage 33 capable of being carried in and out is set on the base 5. Lower dies $3_1$ to $3_3$ are disposed on the carriage 33 at distances therebetween by a predetermined pitch P, and upper liftable dies $4_1$ to $4_3$ are disposed above the lower dies $3_1$ to $3_3$, thus forming three pressing positions 35. The lower dies $3_1$ to $3_3$ and the upper dies $4_1$ to $4_3$ have the same structure as that in the previous first embodiment. A liftable blank holder 19 is provided on the lower die $3_1$ in a first station for drawing a workpiece W. An idle position 36 is established upstream of a pressing position 35 in the first station, and a take-in portion 37 is provided further upstream. A take-out position 38 is provided downstream of the most downstream pressing position 35, thus forming a press line 39 extending from the take-in portion 37 to the take-out portion 38. A pair of left and right guide bars 10 are disposed along the press line 39 and operatively connected to a lifting device 41 provided on the side of the base 5. Below the take-out portion 38 and adjacent the base 5, there is an actuator 43 having a cam shaft 42 operatively connected to a press drive (not shown), and the lifting device 41 is operatively connected to the actuator 43. More specifically, the lifting device 41 is comprised of a rack shaft 44 operatively connected to the cam shaft 42 through a cam, a cam follower and a lever (all not shown) and reciprocally movable along the press line 39, a pinion 45 meshed with the rack shaft 44, a lift shaft 47 operatively connected to the pinion 45 through a rack 46, and a guide arrangement 48 for the lift shaft 47. An upper end of the lift shaft 47 is fixed to the guide bar 10. The lift shaft 47 is provided at each of a plurality of locations and for this reason, a synchronizing device 49 is provided between the lift shafts 47.

Referring to FIGS. 7 to 12, a carriage 50 is provided at one end of the guide bar 10 and reciprocally movable back and forth in a direction along the press line 39. More specifically, the carriage 50 is portal-shaped and fitted over the guide bar 10 from the above, so that it is guided in a supported manner by a plurality of clamping rollers 52, FIG. 8, engaging with guide rails 51, from vertical directions, which are mounted on opposite sides of the guide bar 10, and so that it is guided by a plurality of side rollers 53 engaging with the guide rails 51 from the lateral directions. The cam shaft 42 operatively connected with the press drive through a reduction gearing 63 is operatively connected with the carriage 50 by a feeding device 54. More specifically, the feeding device 54 is comprised of a feeding cam 55 mounted to the cam shaft 42, an L-shaped feeding lever 57 longitudinally swingably mounted to a support shaft 56, a cam follower 58 mounted to the feeding lever 57, a roller 59 mounted on an upper end of the feeding lever 57, a guide member 61 mounted on the carriage 50 to form a vertical groove 60 into which the roller 59 is fitted, and a restraining cylinder 62 for urging the cam follower 58 into abutment against the feeding cam 55.

A quadrangular tubular connecting shaft 65 is disposed along the guide bar 10, and is connected at one end of the connecting shaft 65 to the carriage 50 and supported through a proper support (not shown) for movement toward the guide bar 10. Movable stands 66 are integrally mounted on the connecting shaft 65 at points spaced apart from one another by a predetermined pitch P. A first support 67 and a second support 70 are carried on the movable stand 66 in a location closer to the take-out portion 38 and in a location closer to the take-in portion 37, respectively, through a rail 68 and a slide member 69 for movement toward and away from each other.

A first cross bar $17_1$ is disposed between the first supports 67 opposed to each other about the press line 39, with a detaching device 71 interposed therebetween, and a second cross bar $17_2$ is disposed between the second supports 70 with a detaching device 73 interposed therebetween. Suction cups $18_1$ and $18_2$ as retainers capable of retaining the workpiece W are attached to the cross bars $17_1$ and $17_2$.

A bracket 80 depends from a lower surface of the carriage 50, and a transverse shaft 81 perpendicular to the press line 39 is attached to the bracket 80. A reversed T-shaped lever 82 is supported at its central portion on the transverse shaft 81 and swingable back and forth about a transverse axis 83. A cam follower 84 is mounted to a front end of the lever 82, and a cam plate 86 is attached to the guide bar 10 and has a closed loop-like cam surface 85 on which the cam follower 84 acts. The closed loop-like cam surface 85 is formed from a rectilinear downwardly-directed face 85*a*, a rectilinear upwardly-directed face 85*b* opposed to an intermediate portion of the downwardly-directed face 85*a*, upwardly-directed inclined faces 85*c* and 85*d* continuous to opposite ends of the upwardly-directed face 85*b* and extending angularly and upwardly in opposite directions from such opposite ends, and turned faces 85*e* and 85*f* connecting the ends of the inclined faces 85*c* and 85*d* with opposite ends of the downwardly-directed face 85*a*, respectively. A restraining cylinder 87 is disposed between a rear end of the lever 82 and the carriage 50 and is one example of means for bringing the cam follower 84 into press contact with the cam surface 85. A push-pull shaft 88 is disposed to extend along the guide bar 10 and is operatively connected to the lever 82 through an operating-direction changing device 101 and an operatively connecting-position changing device 89. More specifically, the push-pull shaft 88 is disposed above the connecting shaft 65 and supported at one end side thereof in the operating-direction changing device 101 of a rack-pinion construction attached to the carriage 50. An operating shaft 102 supported in the operating-direction changing device 101 is supported on the carriage 50 through a support member 90 for movement in a pushed and pulled manner. An arm 92 is vertically swingably connected to one end of the operating shaft 102 through a pin 91, and a transverse pin 93 attached to a free end of the arm 92 is fitted in a vertical and arcuate elongated hole 94 provided in the lever 82. In order to change the position of transverse pin 93 fitted in the elongated hole 94, a cylinder arrangement 95 is disposed between the arm 92 and the lever 82. The fitted position can be changed to a plurality of stages by constructing the cylinder arrangement into a multistage type. The arm 92 is of a construction comprising a rod portion 92*a* received in a cylindrical portion 92*b*, so that the arm 92, itself, can be changed over between an operatively connected state and a disconnected state by inserting and withdrawing a fixing pin 97 operated by a cylinder arrangement 96 attached to the cylindrical portion 92*b* into and from between both the portions 92*a* and 92*b*. The operating shaft 102 is provided with a vertical through hole 98, and a cylinder arrangement 100 for operating the fixing pin 99 capable of being inserted into and withdrawn from the through hole 98 is mounted to the carriage 50. These components 98 to 100 constitute a fixing device 103.

The movable stand 66 is provided with a converter 105 for converting the pushing and pulling movement of the push-pull shaft 88 into the movement of the supports 67 and 70 toward and away from each other. That is, the push-pull shaft 88 is constructed of a plurality of members connected, and a portion of the push-pull shaft 88 corresponding to the movable stand 66 is formed into a rack shaft portion 88*a*. A frame 106 supporting the rack shaft portion 88*a* for sliding movement is attached to the movable stand 66 and provided with a pinion 107 meshed with the rack shaft portion 88*a*, and a rack shaft 108 meshed with the pinion 107 and extending in parallel to the rack shaft portion 88*a*. The rack shaft 108 is fixed at 109 to the first support 67, and the push-pull shaft 88 is fixed at 110 to the second support 70.

Thus, the operatively connecting system CS according to the present invention is constructed by combination of the restraining cylinder 87, the cam plate 86, the lever 82, the arm 92, the operating shaft 102, the operating-direction changing device 101, the push-pull shaft 88, the converter 105, the first and second supports 67 and 70, and the first and second cross bars $17_1$ and $17_2$.

Figure 14:
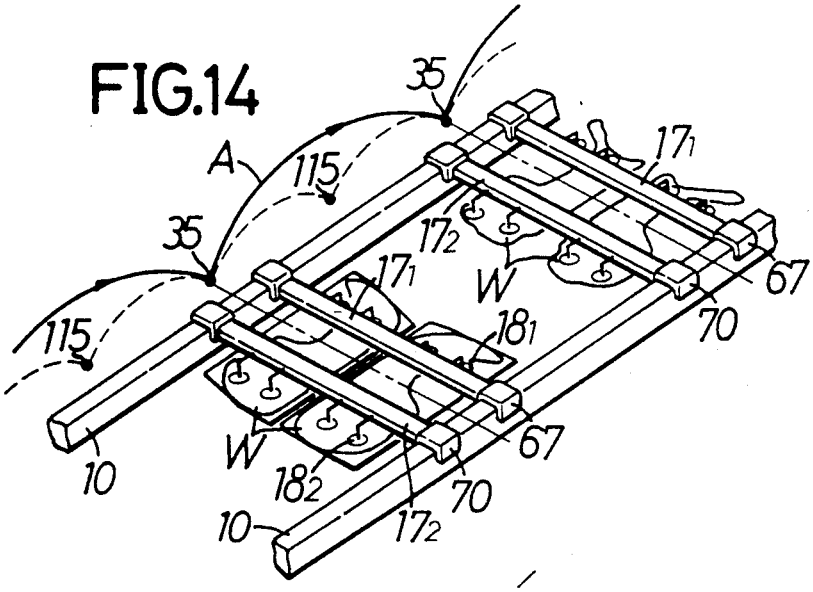

The operation of the second embodiment will be described below. FIG. 14 illustrates a state in which the feeding (A) of the workpiece W is completed. The feeding lever 57 is in its advance limit shown by a dashed line in FIG. 7 and retains the carriage 50, the connecting shaft 65, the movable stand 66 at their advance limits (rightward movement limits as viwerd in FIG. 7). At this time, the first and second cross bars $17_1$ and $17_2$ are in expanded states in which they are spaced from each other at the maximum, and the cam follower 84 lies on the turned face 85*f*. Further, the fixing pin 99 is out of the through hole 98, and the fixing pin 97 is in a state in which it connects the rod portion 92*a* and the cylindrical portion 92*b* of the arm 92 integrally. If the suction cups $18_1$ and $18_2$ are changed over from such condition to their inoperative states, the workpiece W can be brought down into the idle position 36 immediately below the first or second cross bar $17_1$ or $17_2$, the pressing position 35 or the take-out portion 38.

Figure 7:
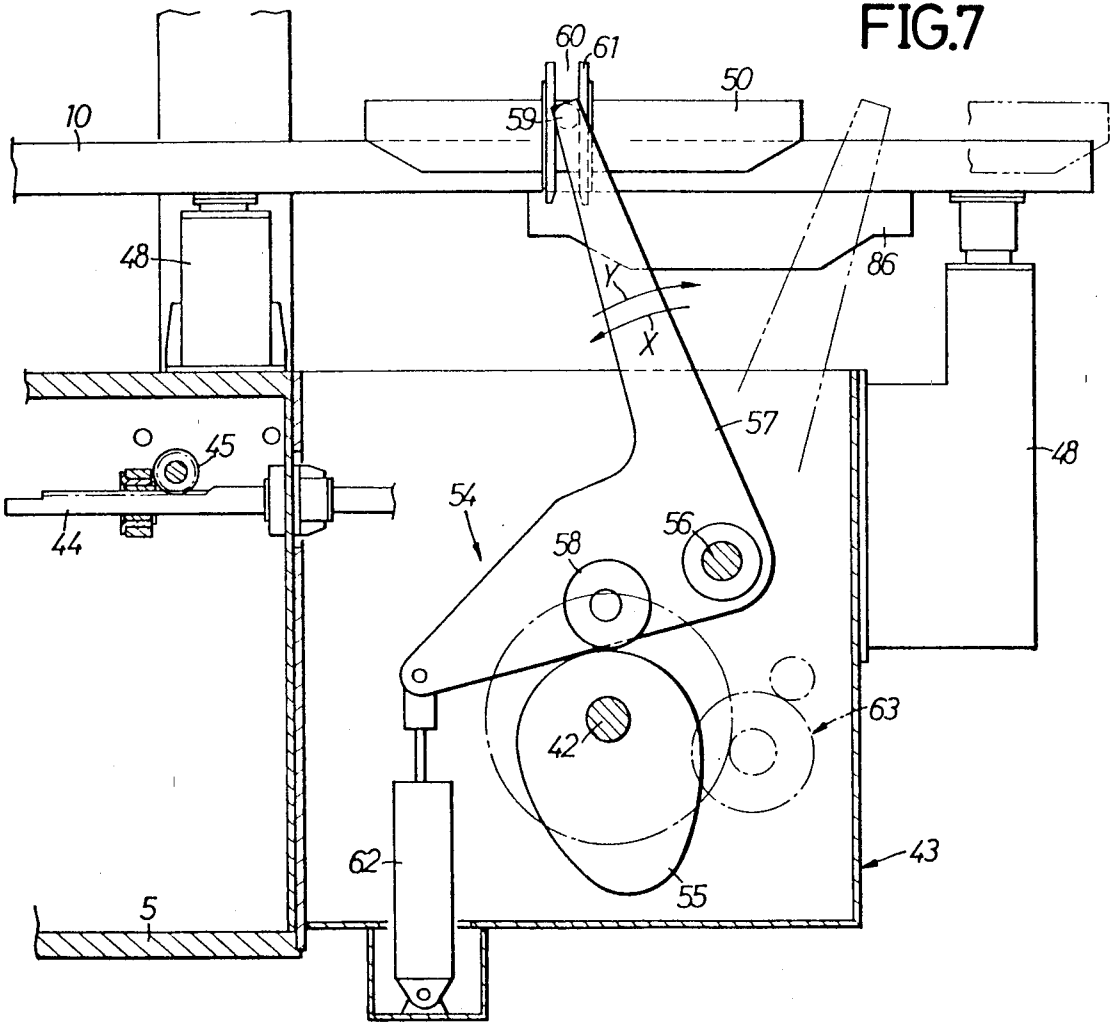
Figure 15:
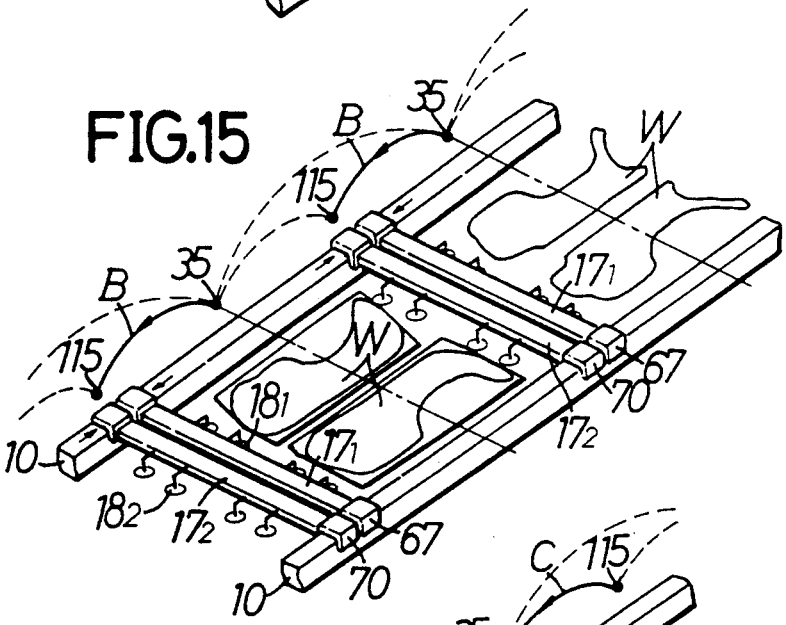

After the workpiece W has been brought down, the feeding lever 57 is swung in a rearward direction as indicated by an arrow X in FIG. 7 to retreat the carriage 50, while raising and lowering the guide bars 10 by the lifting device 41, thereby retreating the first and second cross bars $17_1$ and $17_2$ along an upwardly smoothly curved line as in the previous embodiment. More specifically, the swinging movement of the feeding lever 57 in the direction X causes the carriage 50, the connecting shaft 65, the movable stands 66, the supports 67 and 70 to be retreated and further causes the cross bars $17_1$ and $17_2$ integral with the supports 67 and 70 to be also retreated, so that they are moved to standby positions 115 which are in the middle between the pressing positions 35 as shown in FIG. 15, thus completing the first half B of the retreating step. Such retreating step is conducted in a condition in which the restraining cylinder 87 has been contracted to offset the cam follower 84 downwardly and hence, the cam follower 84 is urged against and guided downwardly on the upwardly-directed inclined face 85*d*, thereby swinging the lever 82 rearwardly about the transverse axis 83. This causes the operating shaft 102 to be moved toward the take-in portion 38 by the aid of the arm 92. This movement causes the push-pull shaft 88 to be pulled in a direction indicated by D by the aid of the operating-direction changing device 101, thereby moving the second support 70 in the same direction. Further, the pulled movement in the direction D results in the movement of the rack shaft 108 in the opposite direction by the aid of the rack shaft 88*a* and the pinion 107 to move the first support 67 in the opposite direction, thereby providing the movement of the cross bars $17_1$ and $17_2$ toward each other (i.e., the spacing reducing movement) in a direction along the press line 39.

When the cross bars $17_1$ and $17_2$ have been retreated to the standby positions 115 as shown in FIGS. 5, 6, 11 and 15, the feeding lever 57 is stopped, and the cross bars $17_1$ and $17_2$ are maintained at their states in which they are closest to each other. In this condition, a predetermined pressing operation for the workpieces W is conducted by cooperation of the lower dies $3_1$ to $3_3$ with the upper dies $4_1$ to $4_3$.

Figure 16:
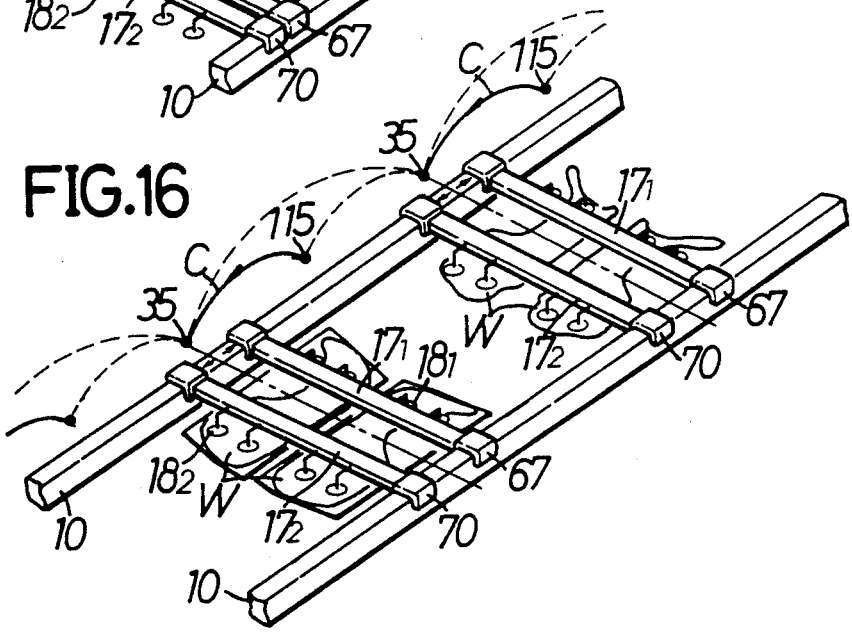

After such pressing operation, the feeding lever 57 is swung in the rearward direction X to the limit, thereby allowing the second or latter half of the retreating step. Specifically, the swinging movement of the lever 57 in the rearward direction X causes the cross bars $17_1$ and $17_2$ to be moved by the aid of the carriage 50, the connecting shaft 65, the movable stands 66 and the supports 67 and 70, while at the same time, raising and lowering the guide bars 10 by the lifting device 41, whereby the cross bars $17_1$ and $17_2$ are retreated to the upstream pressing positions 35 as shown in FIG. 16. Even in the latter half of the retreating step, the cross bars $17_1$ and $17_2$ are retreated along an upwardly smoothly curved line. Upon this movement, the cam follower 84 abuts against the upwardly-directed inclined face 85*c* in FIG. 8, thereby permitting the lever 82 to be swung rearwardly about the transverse axis 83. This swinging movement causes the pushed movement of the push and pull shaft 88 in the direction E by the aid of the arm 92 and the like, and this pushed movement causes the movement of cross bars $17_1$ and $17_2$ away from each other (i.e., the spacing-increasing movement) by the aid of the rack shaft 108. This results in the cross bars $17_1$ and $17_2$ being located on the opposite sides of a pressing center of the upstream pressing position 35 as shown in FIG. 16, so that the suction cups $18_1$ and $18_2$ can attract the workpieces W at locations near their peripheries with a stability.

Then, the restraining cylinder 87 is expanded to bring the cam follower 84 into abutment against the downwardly-directed face 85*a*. The feeding lever 57 which is at a rear limit in this condition is swung to a front limit in the direction Y (as shown in FIG. 7), and at the same time, the guide bars 10 are raised and lowered by the lifting device 41, thereby advancing the cross bars $17_1$ and $17_2$ along the upwardly smoothly curved line to provide the transportation of the workpieces W by the predetermined pitch P as shown by A. During this time, the cam follower 84 is guided on the rectilinear downwardly-directed face 85*a* and hence, the lever 82 is not swung. This ensures that the cross bars $17_1$ and $17_2$ are fed or advanced while remaining in a spaced apart relation into their states shown in FIG. 14. In such position, the suction cups $18_1$ and $18_2$ are brought into their inoperative states to release the workpieces W. At this time, the cam follower 84 lies on the turned face 85*f*, and the restraining cylinder 87 is contracted to lower and restrain the cam follower 84, thereby returning it to the initial state.

When the workpieces W held by the cross bars $17_1$ and $17_2$ are discharged from the lower die $3_1$ of the most upstream drawing mold in the above-described manner, the raising of the blank holder 19 mounted on the lower die $3_1$ is stopped temporarily as in the previous embodiment and hence, the interference of the blank holder 19 with the suction cups $18_1$ and $18_2$ or the workpieces W is prevented.

Thus, the workpieces W can be sequentially transported to the downstream pressing position 35 by repeating the above-described operation. In this case, the transportation of the workpieces W from the take-in portion 37 to the idle position 36, from the idle position 36 to the pressing position 35 and from the pressing position 35 to the take-out portion 38 can be also performed.

Figure 13:
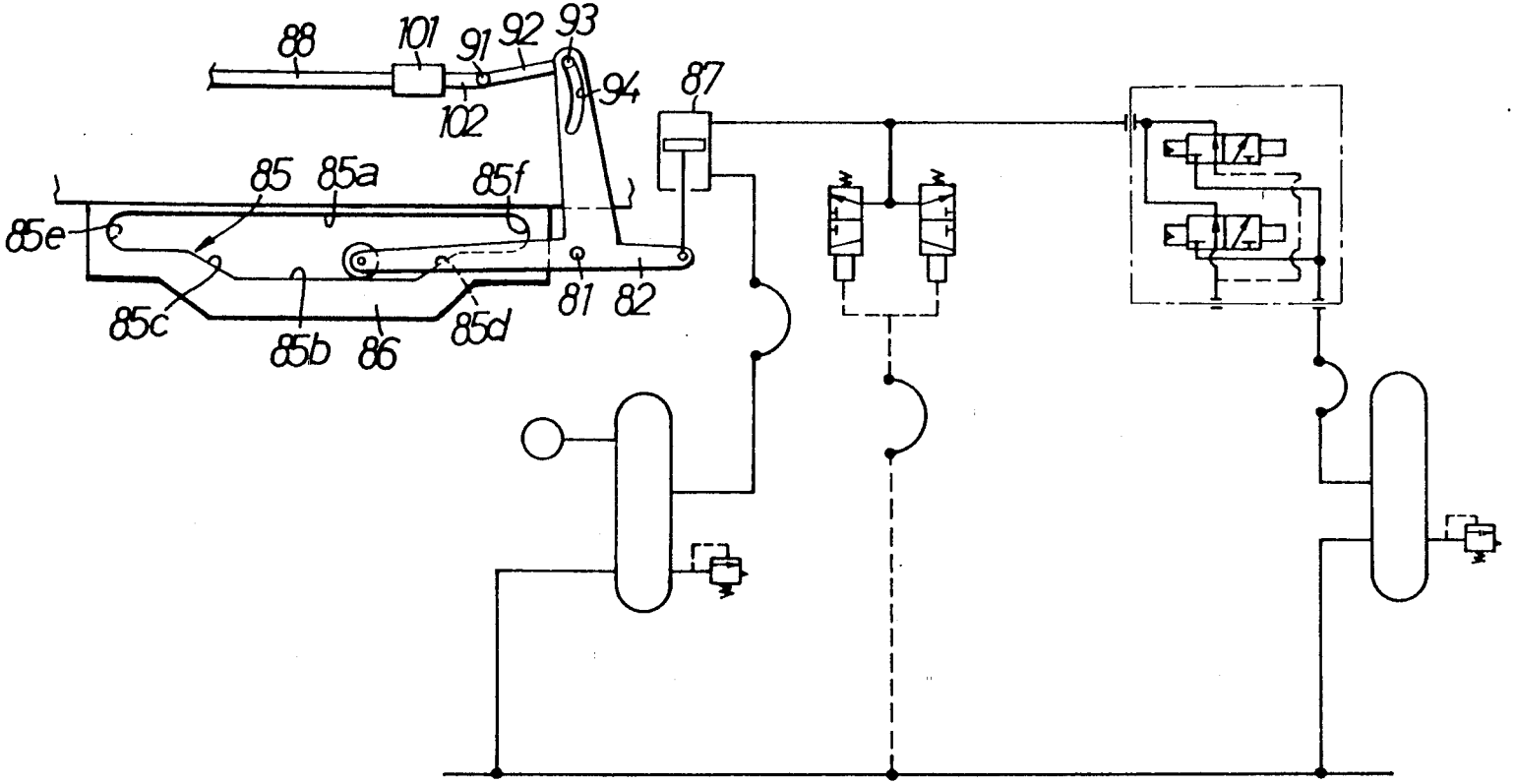

FIG. 13 illustrates a circuit for changing-over the restraining direction of the restraining cylinder 87, which circuit includes a safety circuit provided in a pneumatic system thereof.

Figure 8:
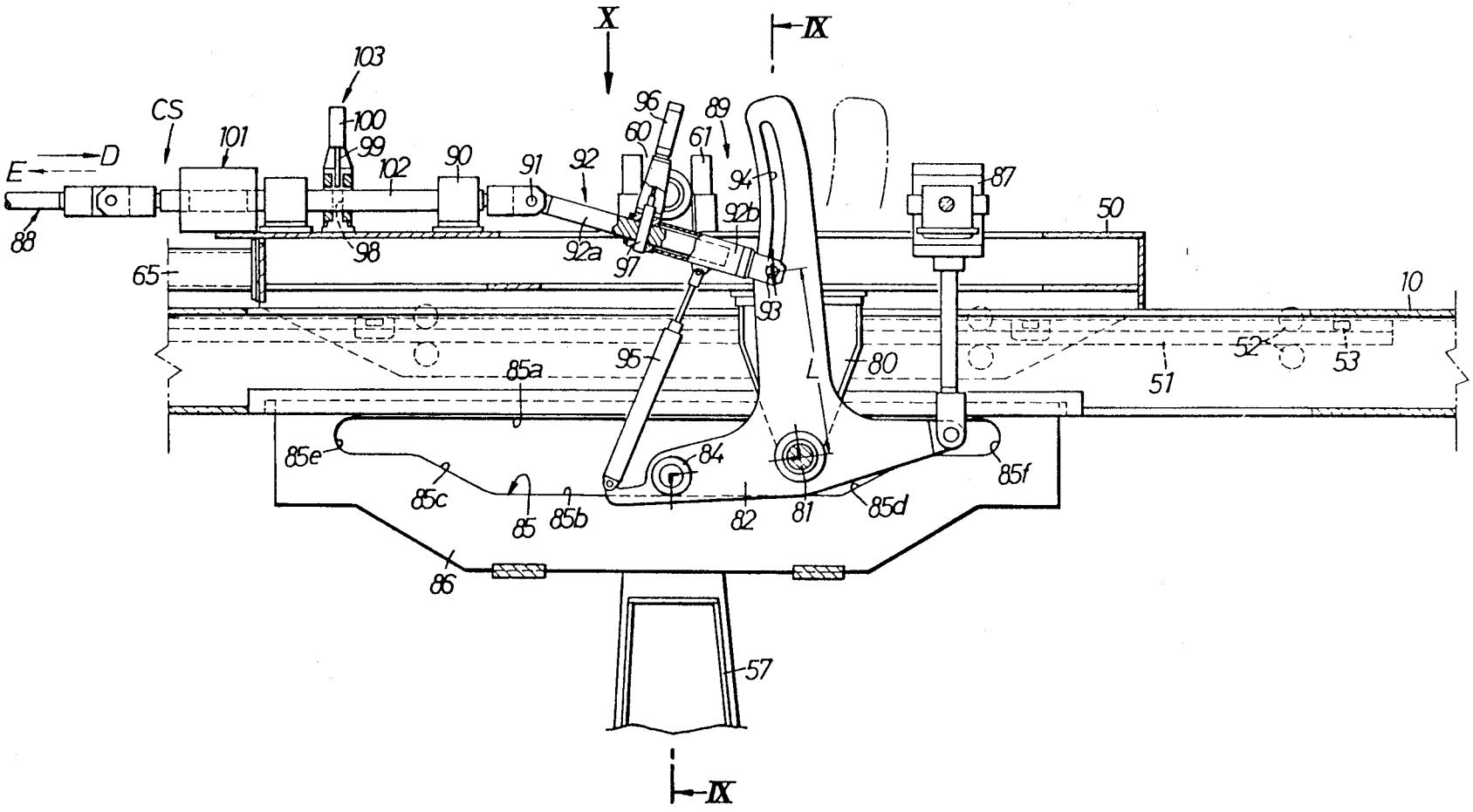
Figure 9:
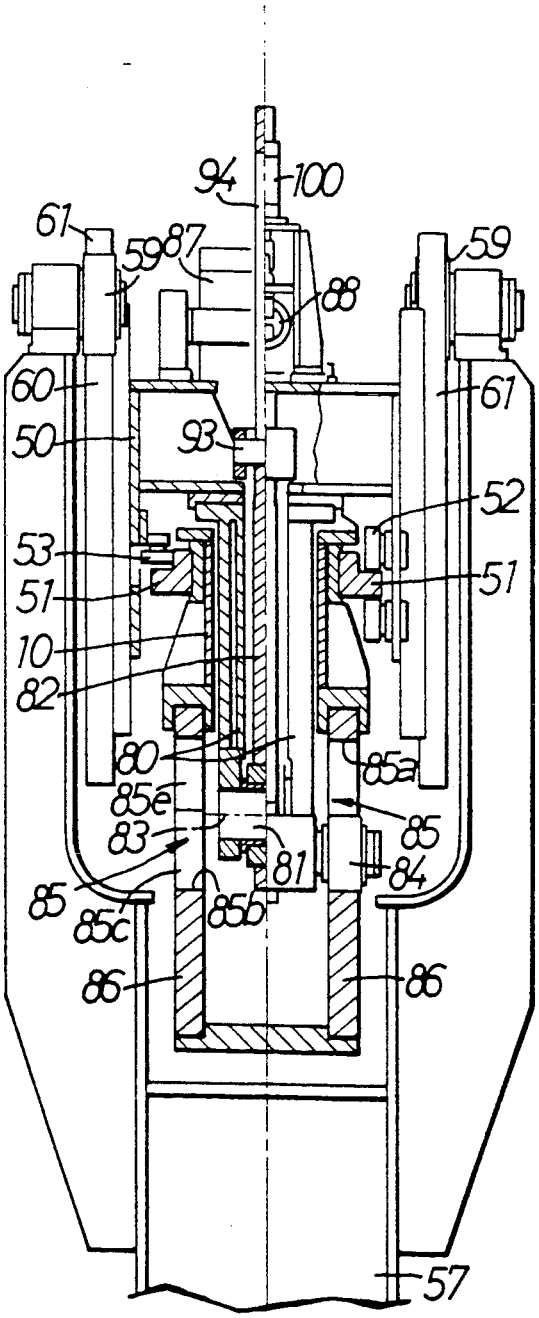
Figure 10:
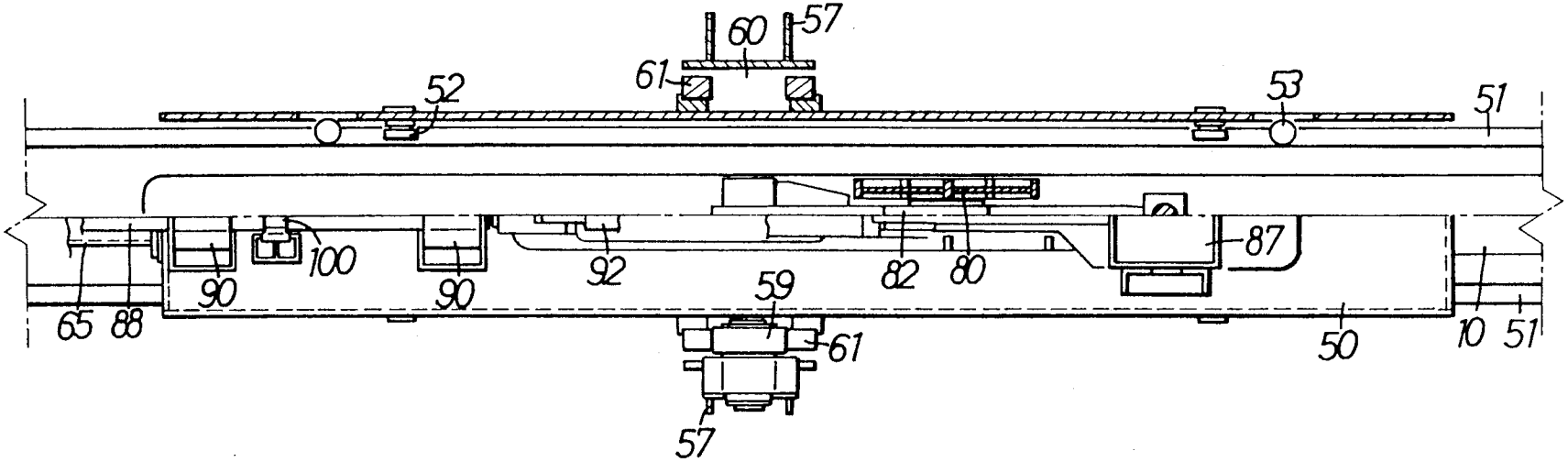
Figure 11:
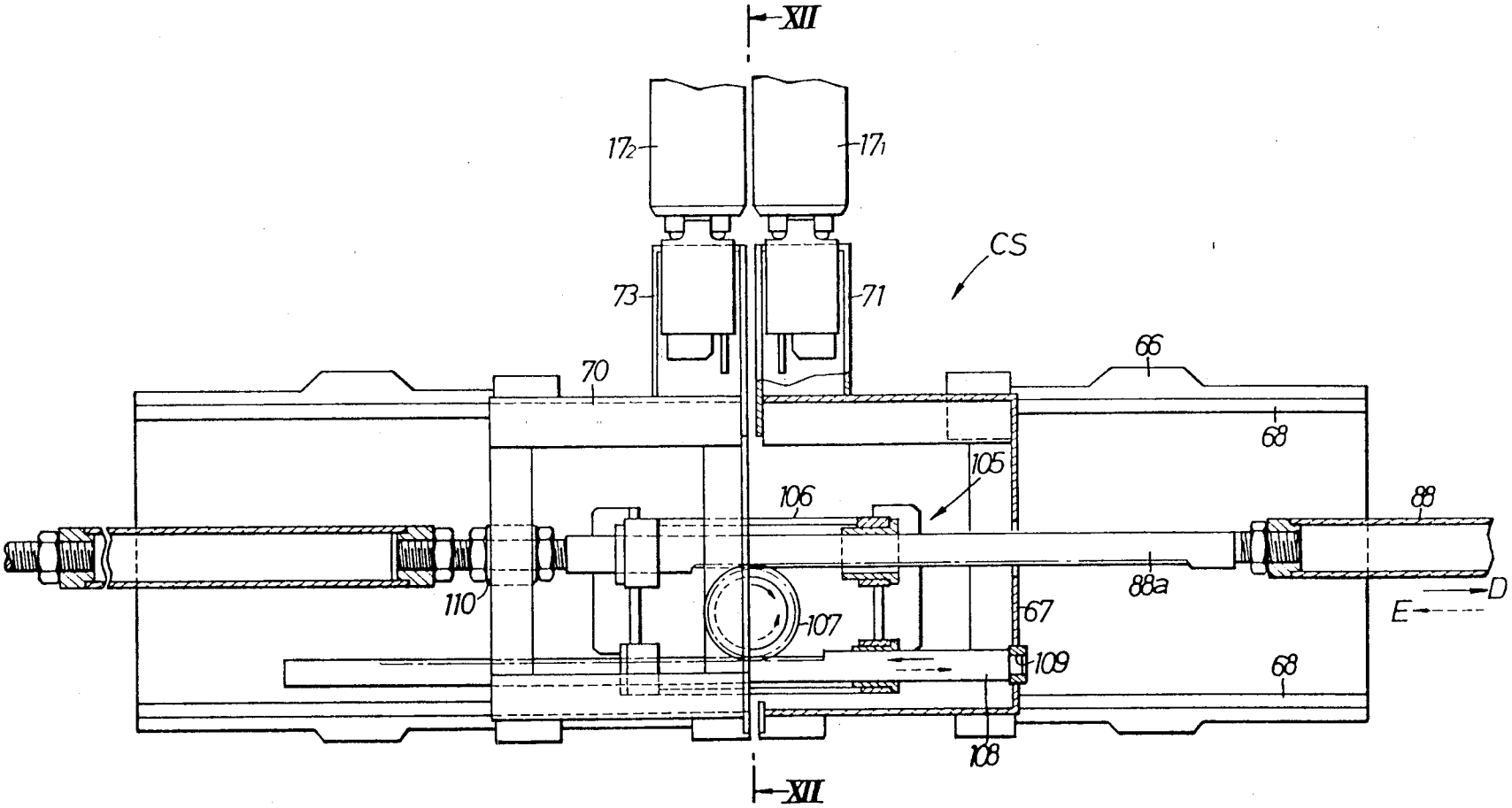
Figure 12:
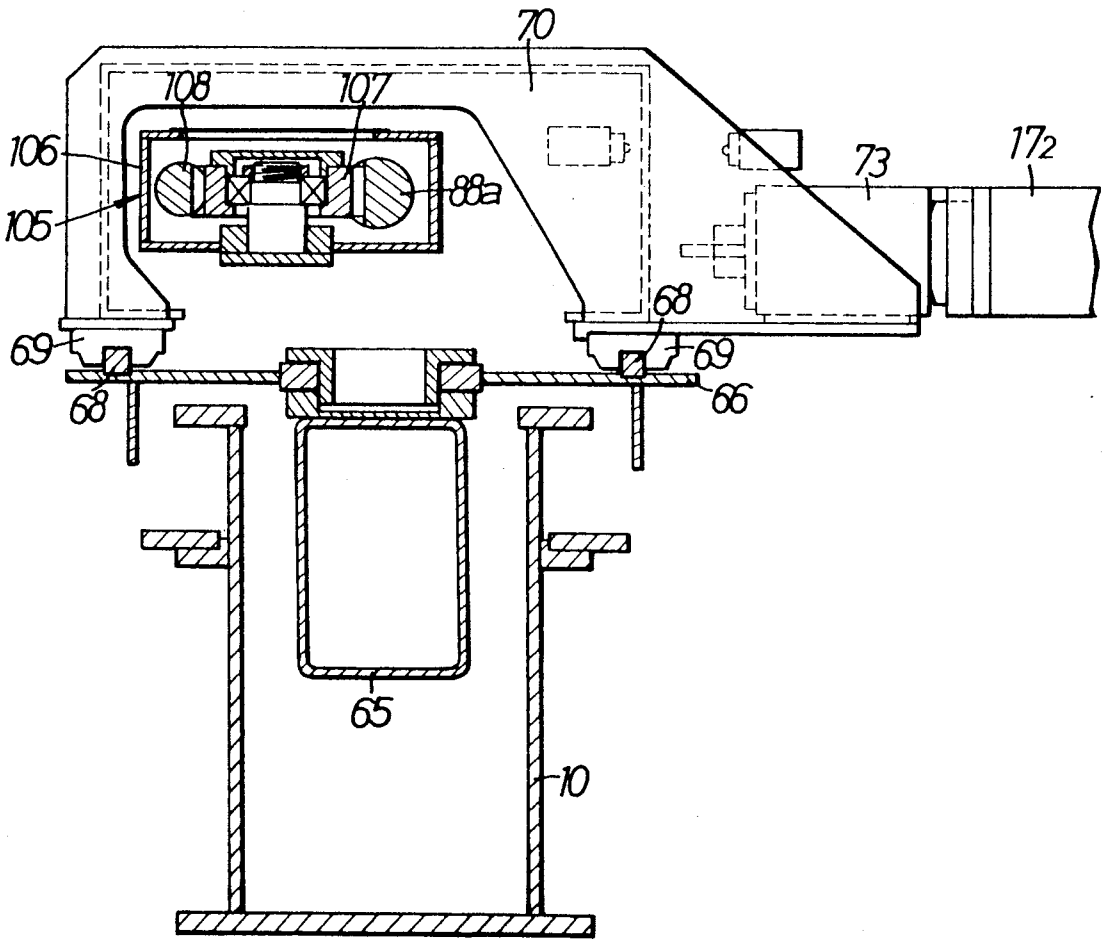

In FIG. 8, the distance L from the transverse axis 83 to the axial center of the transverse pin 93 can be changed as desired by moving the transverse pin 93 within the elongated hole 94 by the operation of the cylinder arrangement 95. This change-over enables the change-over of the distance of movement of the transverse pin 93 while ensuring the constant swinging movement of the lever 82. As a result, the pushed and pulled amount (distance) of the push-pull shaft 88 can be changed to ensure that the distance between the cross bars $17_1$ and $17_2$, when they are moved away from each other, can be changed in accordance with the shape of the workpiece W.

For example, if the workpiece W is small-sized and can stably be transported without the movement of the cross bars toward and away from each other, the cylinder arrangement 100 in the fixing device 103 shown in FIG. 8 is operated to insert the fixing pin 99 into the through hole 98 with the cross bars $17_1$ and $17_2$ having moved toward each other. Then, the cylinder arrangement 96 is operated to withdraw the fixing pin 97, thereby ensuring that the rod 92*a* and the cylindrical portion 92*b* in the arm 92 are slidable movable relative to each other. When the intended pressint operation is conducted in this condition, the swinging movement of the lever 82 is absorbed by the sliding movement of the arm 92 and hence, is not transmitted to the push-pull shaft 88. In addition, the push-pull shaft 88 is locked by the fixing pin 99 and hence, it is possible for the cross bars $17_1$ and $17_2$ to transport the workpieces W while maintaining their spacing-reduced states.

What is claimed is:

1. A method for withdrawing a workpiece from a drawing mold disposed at a working station and formed of an upper die, a lower die and a blank holder, comprising the steps of:

placing the workpiece on the blank holder at a raised position where the blank holder has been moved away from the lower die to substantially its uppermost position;

lowering the holder along with the workpiece toward the lower die of the drawing mold;

applying a drawing operation to said workpiece by cooperation of the upper and lower dies by lowering the upper die against the lower die to shape the workpiece between the dies;

raising the upper die after the drawing operation;

moving the cross bar means from a standby position between the drawing mold and a mold of a next station to a position between the upper and lower dies and for picking up the workpeice from between the upper and lower dies;

picking up the workpiece from between the upper and lower dies by the crossbar means;

moving the cross bar means from between the upper and lower dies while holding the workpiece to the next station and releasing the workpiece at the next station; and holding said blank holder in the lowered position until the workpiece which has been subject to the drawing operation is discharged from the drawing mold by said cross bar means.

2. The method according to claim 1, wherein said cross bar means is formed of a first cross bar and a second cross bar which are disposed with an adjustable distance therebetween in the transporting direction of the workpiece, further comprising the steps of enlarging the distance between the first and second cross bars when these bars pick up and transfer the workpiece between stations.

3. The method according to claim 1, wherein a cylinder is used for raising the blank holder to said raised position;

further comprising the steps of forcibly compressing said cylinder by the upper die pressing the blank holder downwards at the time of drawing operation and, after the drawing operation, permitting the blank holder to be slightly raised by the remaining pressure in the cylinder thereby permitting the drawn workpiece to be released from the lower die.

* * * * *